US006390951B1

(12) United States Patent
Daniel

(10) Patent No.: US 6,390,951 B1
(45) Date of Patent: May 21, 2002

(54) APPARATUS AND METHOD FOR ALIGNING EXERCISE MACHINES

(75) Inventor: Nir Daniel, Ramat Gan (IL)

(73) Assignee: Daniel Bartal Ltd., Bat Yam (IL)

( * ) Notice: Subject to any disclaimer, the term of this patent is extended or adjusted under 35 U.S.C. 154(b) by 0 days.

(21) Appl. No.: 09/423,664

(22) PCT Filed: May 19, 1998

(86) PCT No.: PCT/IL98/00229

§ 371 Date: Feb. 17, 2000

§ 102(e) Date: Feb. 17, 2000

(87) PCT Pub. No.: WO98/52649

PCT Pub. Date: Nov. 26, 1998

(30) Foreign Application Priority Data

May 21, 1997 (IL) ..... 120884

(51) Int. Cl.[7] ..... A63B 21/00
(52) U.S. Cl. ..... 482/4; 482/8; 482/900
(58) Field of Search ..... 482/1–9, 900, 482/902

(56) References Cited

U.S. PATENT DOCUMENTS 4,358,108 A 11/1982 Voris
5,314,391 A 5/1994 Potash et al.
5,335,649 A 8/1994 Randall et al.
5,403,251 A 4/1995 Belisto et al.
5,722,937 A * 3/1998 Smith ..... 482/4
6,135,924 A * 10/2000 Gibbs et al. ..... 482/54

FOREIGN PATENT DOCUMENTS

EP 0 732 127 9/1996

* cited by examiner

*Primary Examiner*—Glenn E. Richman
(74) *Attorney, Agent, or Firm*—Eitan, Pearl, Latzer & Cohen-Zedek

(57) ABSTRACT

There is thus provided in accordance with a preferred embodiment of the invention, an alignment apparatus (110) for use with an exercise machine (100) having an adjustable element (20). The alignment apparatus includes an operating device (114) coupled to the adjustable element for adjustably positioning the adjustable element, a beam emitter (116) connected to the exercise machine, a control device (118) coupled to the operating device, and the beam emitter. The beam emitter emits rays (124) to locate the optimum position of the adjustable element, and the control device actuates the operating device to move the adjustable element to the optimum position.

17 Claims, 7 Drawing Sheets

APPARATUS AND METHOD FOR ALIGNING EXERCISE MACHINES

FIELD OF THE INVENTION

The present invention relates to exercise machines in general and for aligning the machines in particular.

BACKGROUND OF THE INVENTION

There are numerous types of exercising apparatus and equipment which allow the user to develop muscles, lift weights, carry out isometric exercises and generally tone the body and keep fit. Exercise machines have been developed for specific tasks and for multiple exercises. Exercise units typically operate either via a pulley and cable system in opposition to weights or without cable connection. Multiple units allow the user to shift his activity from one type of exercise to another.

A typical example of a multiple-exercise machine is described in U.S. Pat. No. 4,986,538 to Ish, which includes a press station at which exercises are performed in opposition to a selected amount of weights. The press station includes a pivotably mounted, swing link unit allowing the user to manipulate the link unit into various alternative positions for different types of exercises.

To obtain the maximum benefit from the use of exercise machines, they must be used efficiently. The user needs to ensure that the force being applied by weights, for example, to a muscle group being exercised is correctly transmitted. Failure to do so and improper use of such machines can lead to injury.

SUMMARY OF THE INVENTION

An object of the present invention is to provide apparatus for use with all types of exercise machines so as facilitate the correct use of such machines.

There is this provided, in accordance with a preferred embodiment of the invention, alignment apparatus for use with an exercise machine having an adjustable element. The alignment apparatus includes an operating device coupled to the adjustable element for adjustably positioning the adjustable element beam emitter connected to the exercise machine and a control device coupled to the operating device and the beam emitter. The beam emitter emit rays to locate the optimum position of the adjustable element and the control device actuates the operating device to move the adjustable element to the optimum position.

Furthermore, in accordance with a preferred embodiment of the invention, the exercise machine includes at least one pivotal element connected to the adjustable element and a resistive component providing a counter force to the pivotal movement of the pivotal element. The pivotal movement actuated by the body part being exercised. The beam emitter is connected to the pivotal element and each of the beam emitters is located on an axial line about which the pivotal element pivots.

Furthermore, in accordance with a preferred embodiment of the invention, the optimum position is determined by the beam emitted by the beam emitter being aligned with the joint of the body part being exercised.

Furthermore, in accordance with a preferred embodiment of the invention, the beam emitters emit light within the visible spectrum.

Additionally, in accordance with a preferred embodiment of the invention, the apparatus further includes at least one receiver to receive rays emitted by the beam emitter.

Furthermore, in accordance with a preferred embodiment of the invention, the control device includes a processing unit. The processing unit processes data related to the rays being emitted and received, and controls the operation of the operating device.

Furthermore, in accordance with a preferred embodiment of the invention, the operating device includes an electric motor or a hydraulically or pneumatically driven unit.

Additionally, in accordance with a preferred embodiment of the invention, the beam emitters are coupled to the operation of the operating device.

Additionally, there is provided, in accordance with a preferred embodiment of the invention, a method for aligning an exercise machine having an adjustable element The method includes the steps of:

a. activating a beam emitter;

b. locating the optimum position of the adjustable element; and c. actuating an operating device to operatably move the adjustable element to the optimum position.

Furthermore, in accordance with a preferred embodiment of the invention, the step of locating the optimum position includes the step of aligning the joint of the body part being exercised with the beam being emitted by beam emitter.

In addition, in accordance with a preferred embodiment of the invention, the method further includes the step of receiving rays emitted by the at least one beam emitter. Also, the method further includes the step of processing data related to the rays being emitted and received. The step of processing data can include controlling the operation of the operating device.

Furthermore, in accordance with a preferred embodiment of the invention, the steps of activating the beam emitter and actuating the operating device are coupled together.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
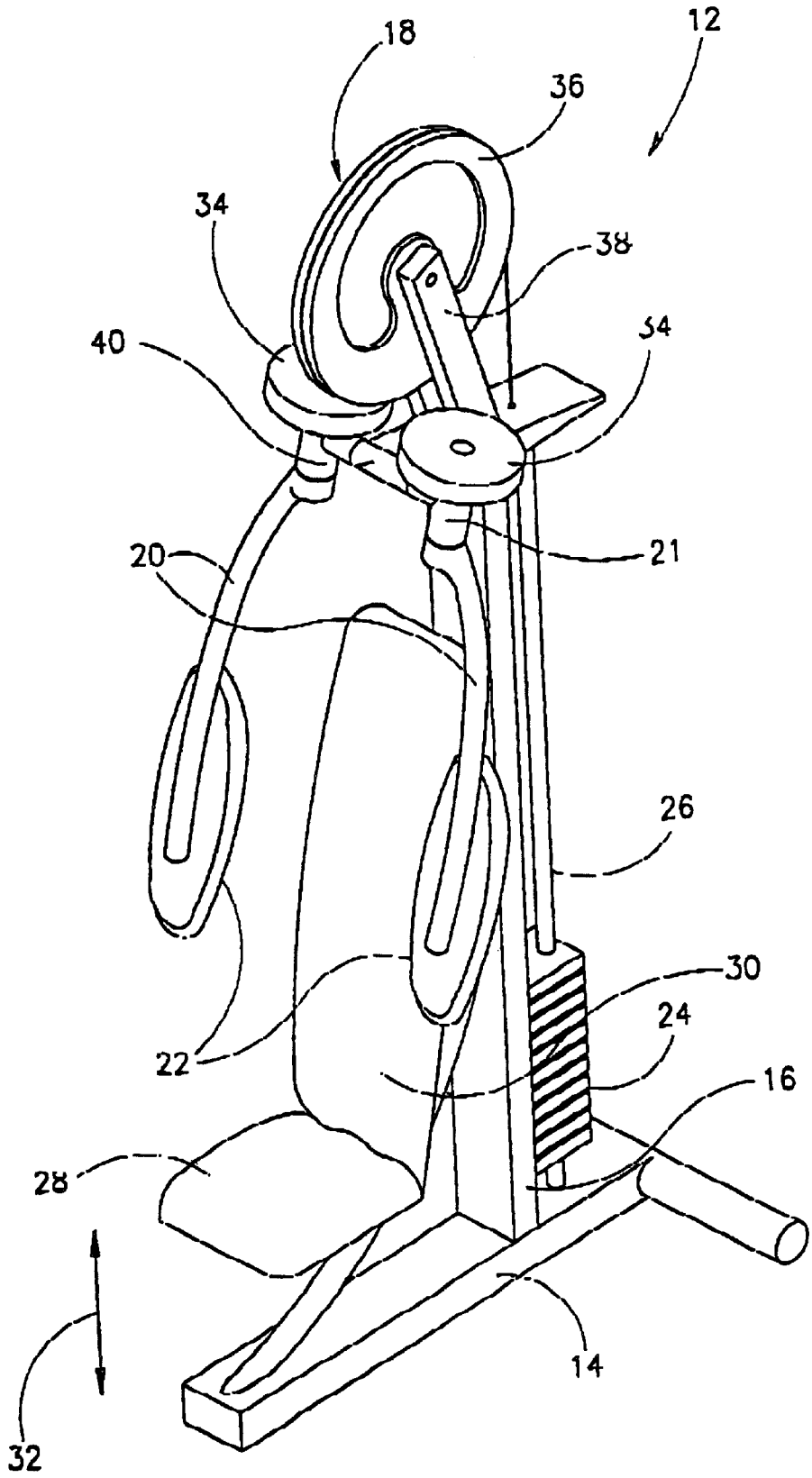
FIG. 1 is a isometric illustration of a prior art exercise machine.

Reference is made to FIG. 1 which is an isometric illustration of a prior art exercise machine, generally designated 12, typically used for exercising of the upper body muscles. Exercise machine 12, generally comprises a base 14 having a column 16 attached thereto A pulley arrangement, generally designated 18 is suitably attached to the top of column 16. A pivotable pair of arms 20 are connected to the pulley arrangement 10. A hand grip 22 is attached to one end (distal from pulley arrangement 18) of each of the pivotable pair of arms 20.

A stack of weights 24 is connected via a cable 26 and the pulley arrangement 18 to operatively provide a counter force to the pivotal movement of the pair of arms 20. Exercise machine 12 further comprises a seat 28 and a back support 30. Seat 28 is adjustable along a vertical axis, referenced 32, generally parallel to column 16.

In operation, the user lifts the stack of weights 24 by gripping the hand grips 22 and pivotally moving the pair of arms 20 attached to the pulley arrangement.

The exemplary pulley arrangement 18 (illustrated in FIG. 1) comprises a pair of pulleys 34, each one of which is attached to the top of one of the arms 20, and at least one transfer pulley 36 attached to an arm 38 extending from column 16. Arms 20 are suitably connected, via a generally cylindrical member 21, to a generally horizontal member 40. Arms 20 are pivotably connected to member 21. Pulley 34 is rotatable about member 21.

Figure 2:
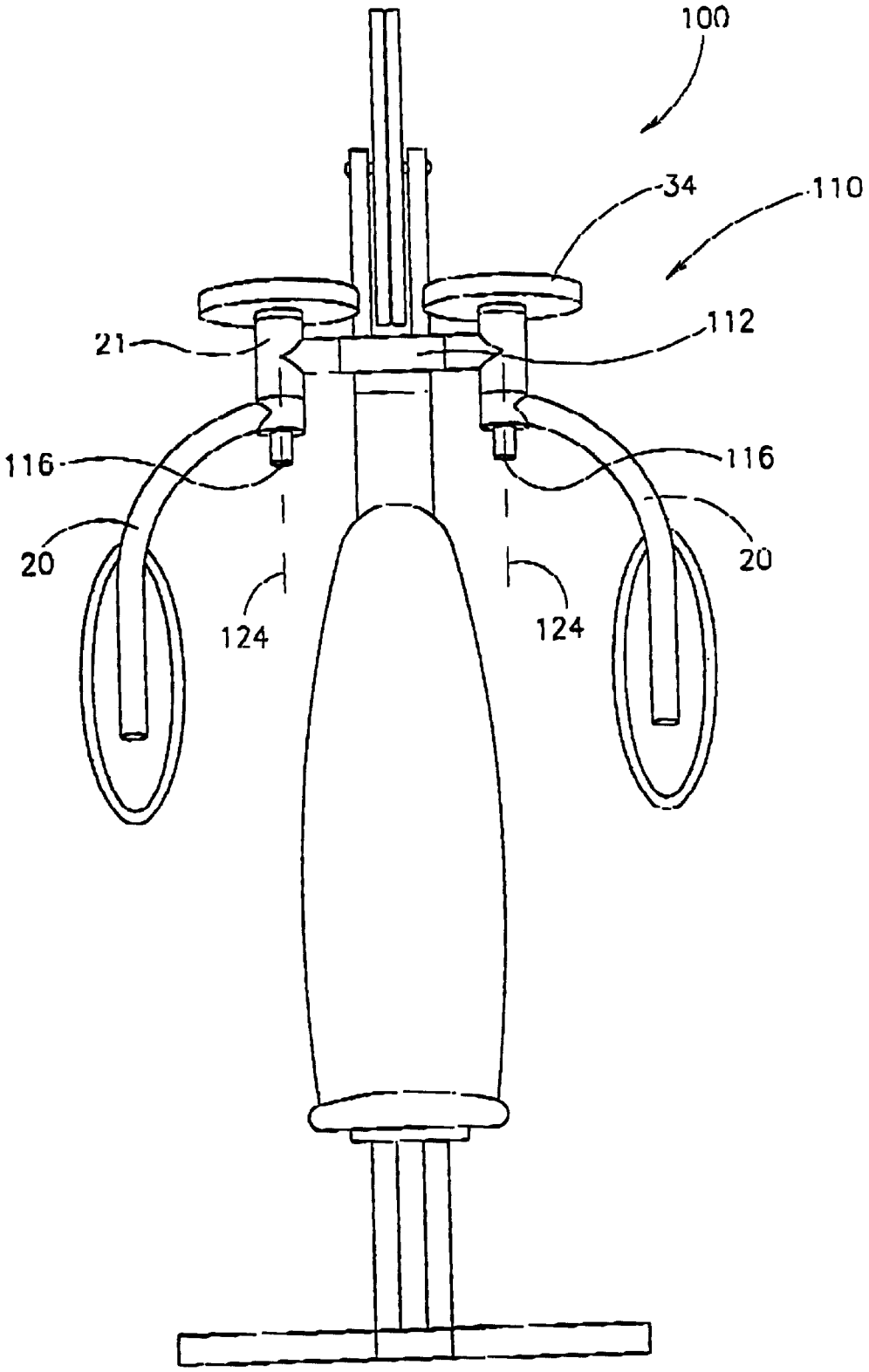
FIG. 2 is a front elevational view of an exercise machine incorporating alignment apparatus, constructed and operative in accordance with a preferred embodiment of the present invention.
Figure 3:
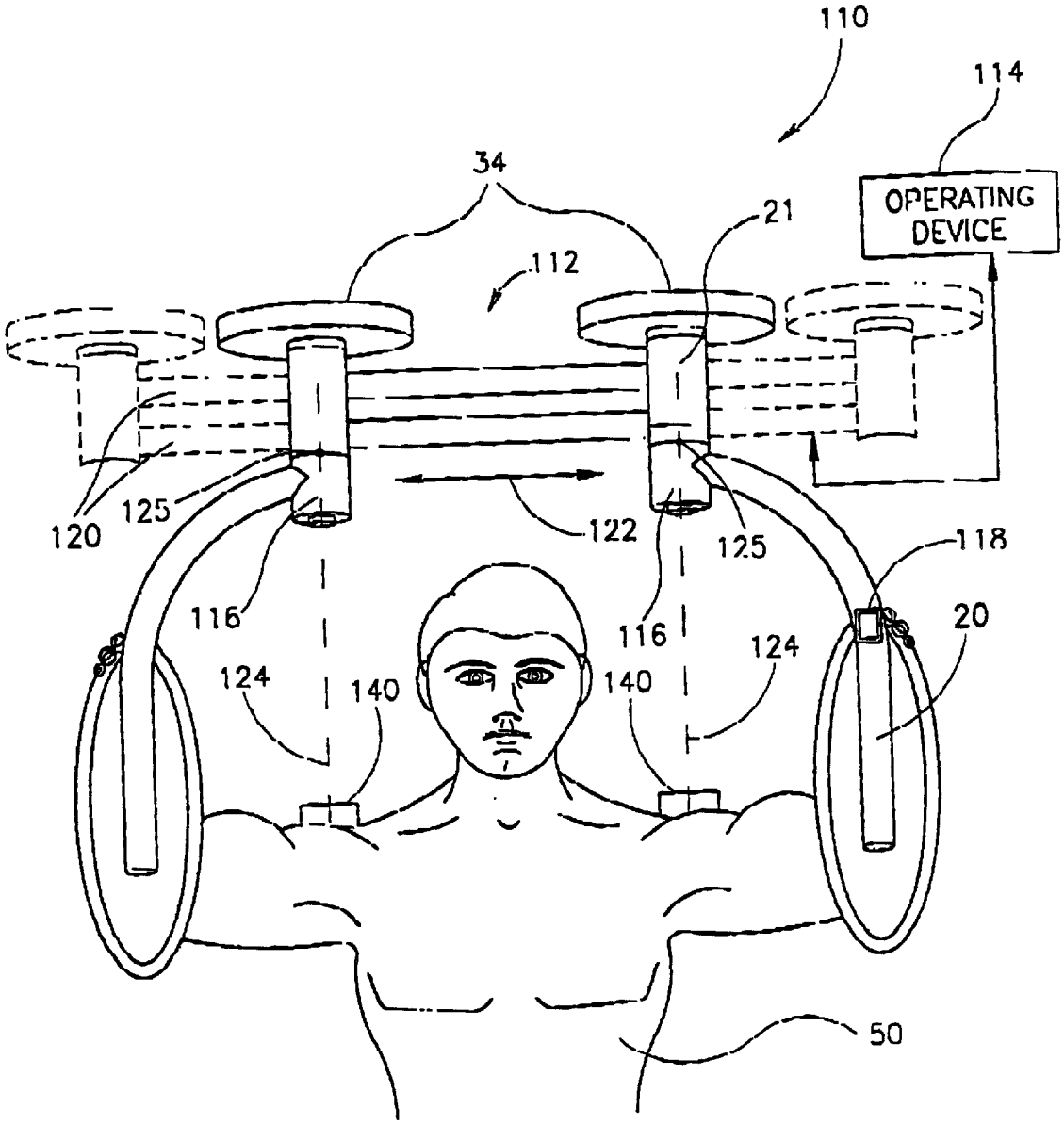
FIG. 3 is an enlarged detail of part of the exercise machine of FIG. 2.
Figure 4:
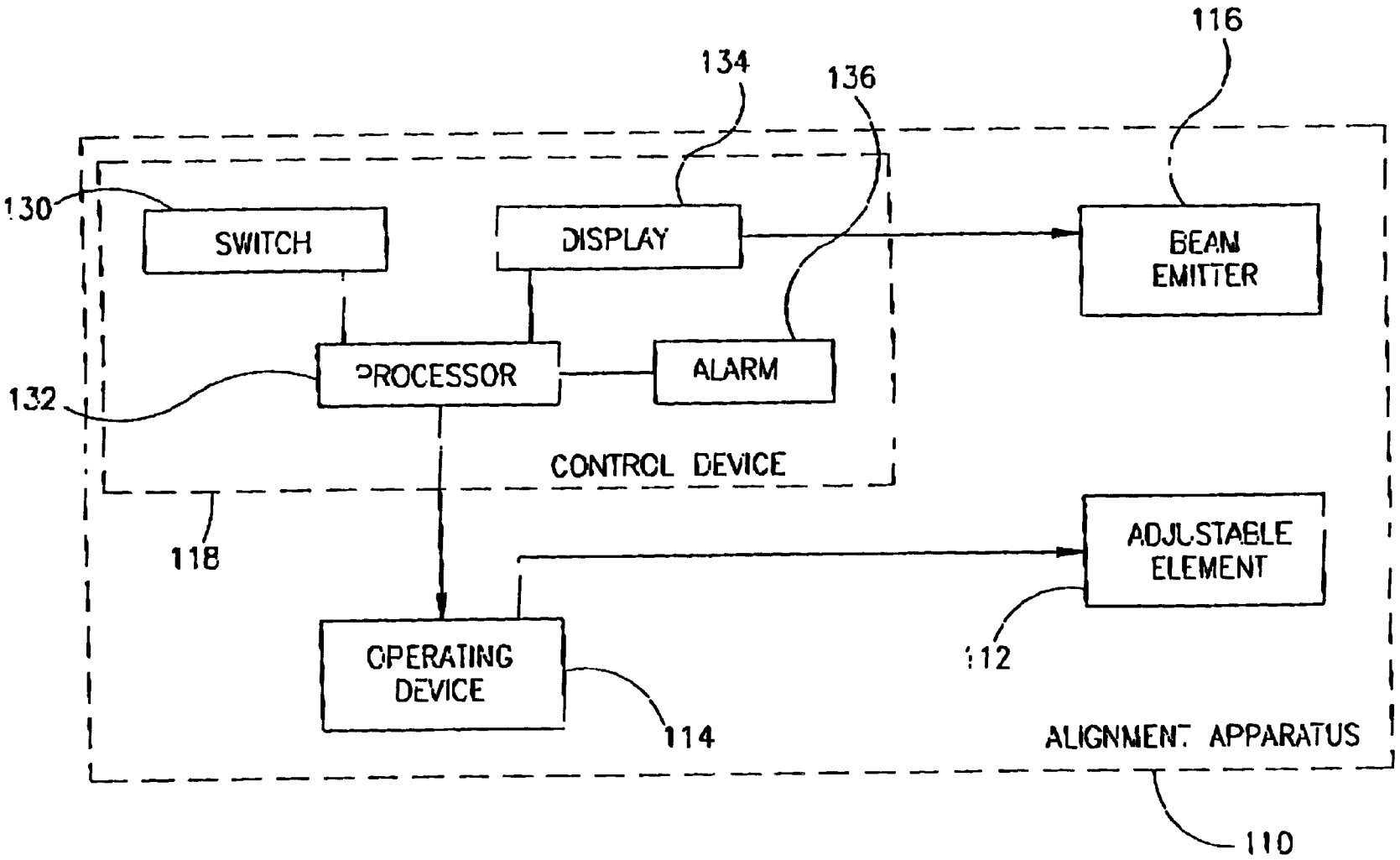
FIG. 4 is a schematic block diagram illustration of the components of the alignment apparatus.

Reference is now also made to FIGS. 2–4, a front elevational view of an exercise machine 100, constructed and operative in accordance with a preferred embodiment of the present invention. FIG. 3 is an enlarged detail of part of the exercise machine 12 and FIG. 4 is a schematic block diagram illustration of the components of the alignment apparatus 110.

Exercise machine 100 is similar to exercise machine 12, described hereinabove with respect to FIG. 1 comprising similar elements which are similarly designated.

Exercise machine 100 further comprises alignment apparatus, generally designated 110, coupled to exercise machine 100. Alignment apparatus 110 an comprises an adjustable track member 112 which allows the user to adjust the exercise machine 100 to its correct and optimum position.

Adjustable track member 112 replaces member 40 (in exercise machine 12 of FIG. 1). Track member 112, which is connected to arms 20 via members 21, comprises a pair of slidably interconnected channel members 120.

Alignment apparatus 110 comprises an operating device 114, a pair of beam emitters 116 and a control device 118.

Track member 112 is coupled to operating device 114. Operating device 114 is also connected to control device 118 and beam emitters 116.

Operating device 114, which may be any suitable motor, such as an electric motor or a hydraulically or pneumatically driven unit, is operable to move track member 112 along a generally horizontal plane (indicated by arrow 122).

Beam emitters 116 are preferably any suitable emitter for emitting a ray of light. The light rays (dashed lines 124) include but are not limited to light within the visible spectrum, such as laser rays.

The control device 118 is any suitable device, known in the art, such as for controlling the operation of the operating device 114 and emitters 116. Control device 118 comprises at least a switch 130 and optionally may further comprise a processor 132, a display screen 134 and a visible and/or audible alarm indicator 136. All the components of control device 118 are standard and commercially available and will not be further described.

Control device 118 may be powered by batteries or electrical means and may be a remote controlled unit. An exemplary location for attaching the control device 118 is one of the hand grips 22 (such as shown in FIG. 3).

In order to obtain the optimum benefit from using the type of exercise machine illustrated in FIGS. 1 and 2, the pivot points (referenced 125) of the pair of arms 20 should be above the shoulder joints of the user. Since the distance between the shoulder joints vary from person to person, the majority of users of an exercise machine, having a fixed member of the type illustrated in FIG. 1, will not obtain the optimum benefit. Generally, the pivot point of the component of the exercise machine being moved should be directly above the joint of the body part being exercised. Thus, by utilizing a light beam, for example, which aligns with the axial line (same as line 124) about which the component pivots, the user can adjust the adjustable element until the light beams meet the shoulder joints.

In the embodiment illustrated in FIGS. 2 and 3, the user can adjust the width between the pivot points 125 (by means of control device 118) by opening and closing the movable track member 112 until the rays of light being emitted by beam emitters 116 are located on the shoulder joints. Optionally, the "optimum" width between pivot points 125 can be displayed on the display screen 134. Alternatively, knowing the optimum width, the user can input the desired width to the control device 118 and movable track 112 will be adjusted accordingly.

It will be appreciated by persons knowledgeable in the art, that there are numerous alternatives, additions and variations, all of which fall within the scope of the present invention, which may be made to the control device 118 of present invention. For example, memory and a storage device may be added.

Alternatively, the beam emitters 116 may be coupled to operating device 114 so that the emitted beam is switched on and off automatically with the operation of the operating device 114.

In an alternative embodiment, alignment apparatus 100 further comprises light sensitive receptors (referenced 140 in FIG. 3) which may be suitably attached to the body of the exerciser. For example, receptors 140 may be attached to the person's shoulders (FIG. 3) in the desired position Receptors 140 are coupled to the control device 118.

In this embodiment, to correctly align the exercise machine, the beam emitters 116 are switched on. Operating device 114 is then activated to move the track member 112. When the receptor 140 receives rays emitted from the beam emitter 116, an alarm 136 can be indicated and operating device 114 automatically stopped.

Figure 5:
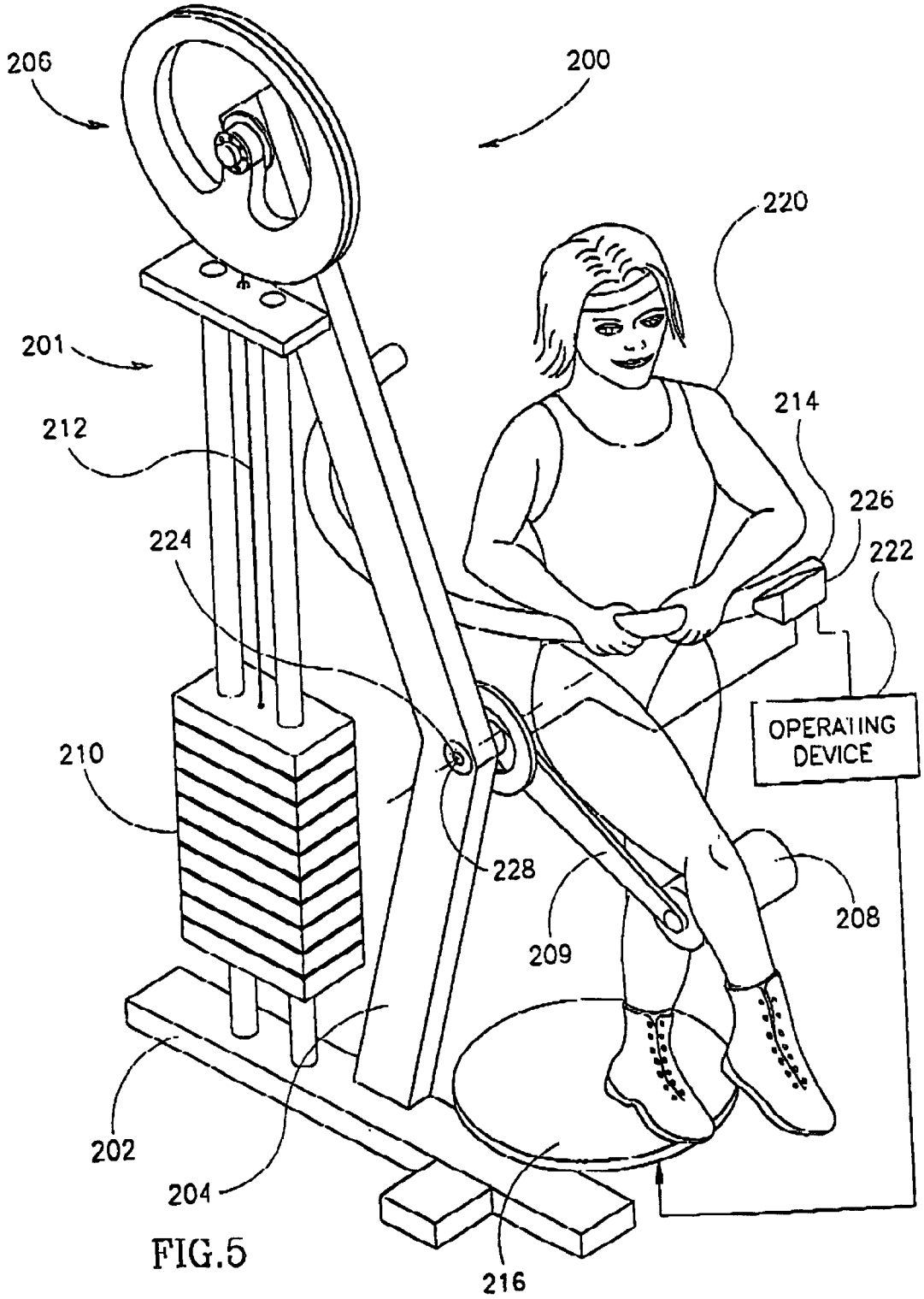
FIG. 5 is a partly schematic, isometric illustration of alignment apparatus attached to an exercise machine in accordance with another preferred embodiment of the present invention.

Reference is now made to FIG. 5 which is a partly schematic, isometric illustration of the alignment apparatus, generally designated 200 attached to an exercise machine, generally designated 201 in accordance with another preferred embodiment of the present invention.

Exercise machine 201 is typically used for exercising the hips and lower part of the body. Exercise machine 201 generally comprises a base 202 having a column 204 attached thereto. A pulley arrangement, generally designated 206 is suitably attached to the top of column 204. A leg support 208 is connected to a lever arm 209, which is itself pivotally connected to the pulley arrangement 206. A stack of weights 210 is connected via a cable 212 and the pulley arrangement 206 to operatively provide a counter force to the pivotal movement of leg support 208.

Exercise machine 201 further comprises an adjustable platform 216, which may be raised or lowered and an arm rest 214 connected to column 204. Arm rest provides support for the user of the machine and is an exemplary location for control device 226 (described below).

During exercise, the user 220 presses on leg support 208 to force lever arm 209 in a generally downward direction thereby causing the stack of weights 210 to be raised.

Alignment apparatus 200 is similar to alignment apparatus 110, described hereinabove with respect to FIGS. 2 and 3. Elements of this embodiment of the invention which are similar to elements which have been previously described with respect to the preferred embodiment hereinabove, are similarly designated and will not be further described.

Alignment apparatus 200 comprises an operating device 222, a beam emitter 224 and a control device 226.

Operating device 222, which may be any suitable motor, such as an electric motor or a hydraulically or pneumatically driven unit, is operable to raise or lower the platform 216.

In order to obtain the optimum benefit from using exercise machine 201, the exerciser should pivot about their hips. In other words, the exerciser's hips should be aligned with the pivot point (referenced 228) of lever arm 209. In order to ensure that the exerciser obtains the maximum benefit from using this type of machine, the exerciser user 220 utilizes control device 226 to operate the beam emitter 224 and raise or lower platform 216 until the rays of light being emitted from beam emitter 214 align with the hip joint. Thus, variations in a person's height can be accommodated. Preferably, the machine 201 is located opposite mirrors, as in common practice—gymnasiums, so that the user 220 can see the light.

Alternatively, the user can input his height in order to automatically cause platform 216 to be adjusted to the required level.

Figure 6:
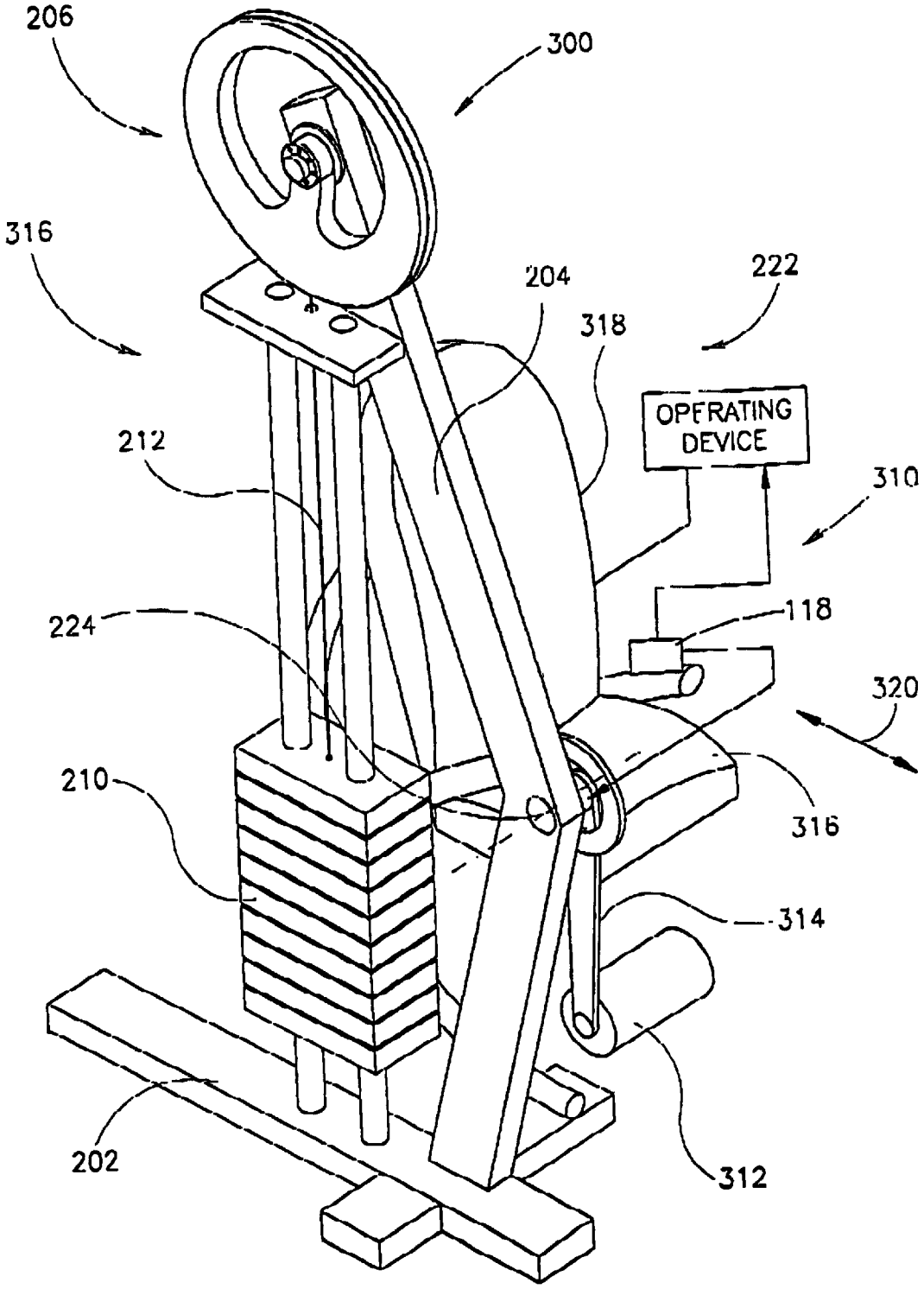
FIG. 6 is a partly schematic, isometric illustration of the alignment apparatus attached to an exercise machine in accordance with another preferred embodiment of the present invention.

Reference is now briefly made to FIG. 6 which is a partly schematic, isometric illustration of the alignment apparatus, generally designated 300 attached to an exercise machine, generally designated 310 in accordance with another preferred embodiment of the present invention.

Exercise machine 310 is typically used for exercising the leg muscles and lower part of the body. Exercise machine 310 is similar to exercise machine 201, described hereinabove with respect to FIG. 5. Elements of this embodiment of the invention which are similar to elements which have been previously described with respect to the preferred embodiment hereinabove, are similarly designated and will not be further described.

Exercise machine 310, generally comprises a base 202 having a column 204 attached thereto and a pulley arrangement, generally designated 206 suitably attached to the top of column 204. A leg support 312 is connected to a lever arm 314, which is itself pivotally connected to the pulley arrangement 206. A stack of weights 210 is connected via a cable 212 and the pulley arrangement 206 to operatively provide a counter force to the pivotal movement of leg support 312.

Exercise machine 310 further comprises a seat 316 and an adjustable back support 318. Back support 318 is adjustable along a generally horizontal axis (indicated by arrows 320) so that the distance between the back support 318 and the front of the seat 316 can be varied.

In operation, the user lifts leg support 312 to lift lever arm 314 up thereby causing the stack of weights 210 to be raised.

Alignment apparatus 300 is similar to alignment apparatus 200, and comprises an operating device 222, a beam emitter 224 and a control device 226. Control device 226 is connected to beam emitter 224 and operating device 222. Operating device 222 is connected to back support 318.

In the embodiment of the exercise machine 310, the exerciser should be seated so that his knee joint is aligned with the pivot point (referenced 228) of lever arm 314 In order to ensure that the exerciser obtains the maximum benefit from using this type of machine, the exerciser utilizes control device 226 to operate the beam emitter 224 and adjusts back support 318 until the rays of light being emitted from beam emitter 214 align with the hip joint. Thus, the exercise machine can be adjusted for persons of different stature.

Alternatively, the user can input his height, for example, in order to automatically adjust the back support.

Figure 7:
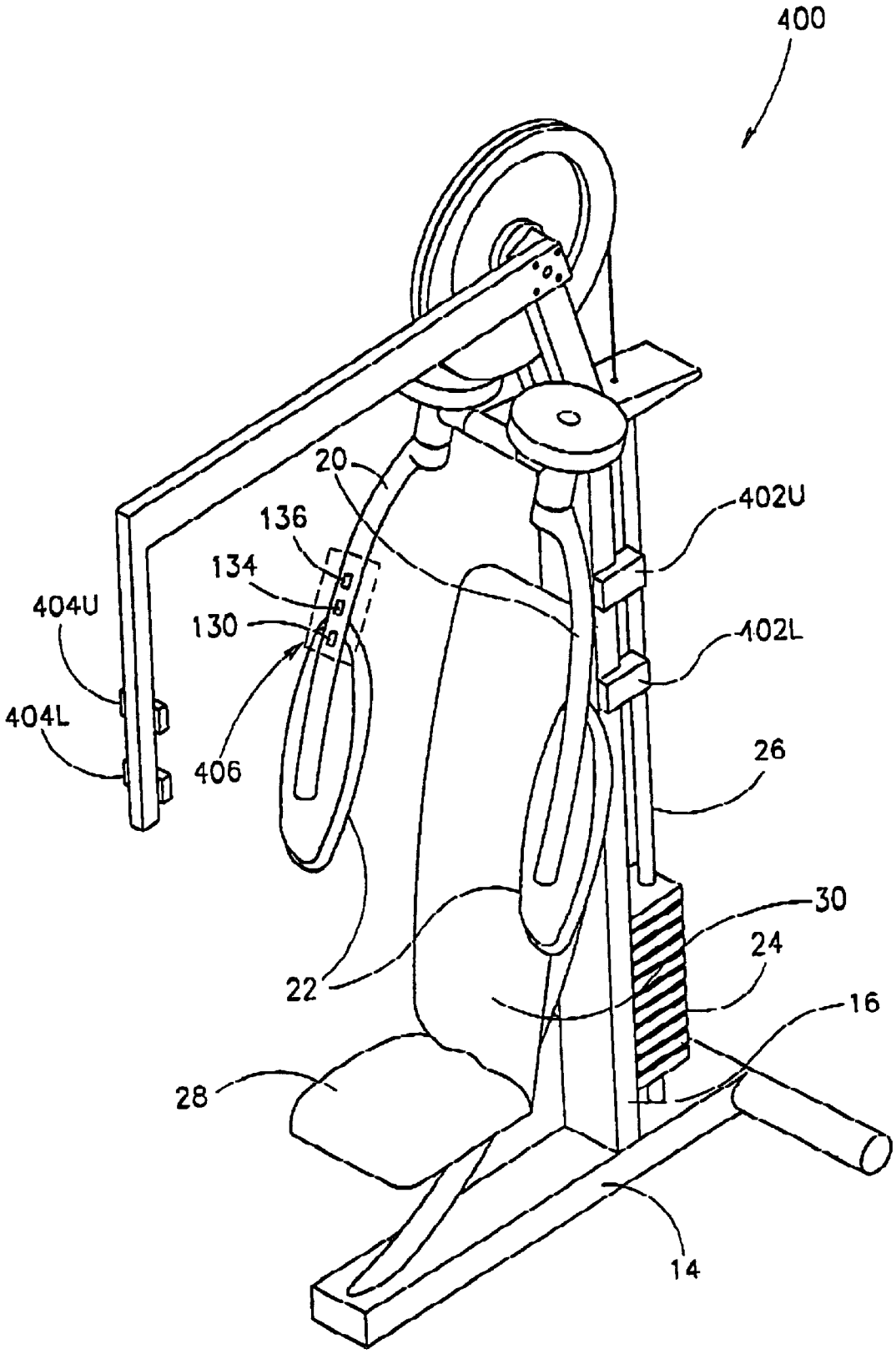
FIG. 7 is an isometric illustration of the alignment apparatus, in accordance with another preferred embodiment of the present invention, attached to an exercise machine of FIG. 2.

Reference is now made to FIG. 7 which is an isometric illustration of an alternative embodiment of alignment apparatus, generally designated 400, connected to exercise machine 100 (of FIG. 2).

Alignment apparatus 400 comprises at least one beam emitter 402, (referenced 402*u* and 402*l*), at least one receiver 404, (referenced 404*u* and 404*l*) and a control device 406. Light transmitted by beam emmitter (402*u*/402*l*) is received by receiver 404*u*/404*l*). Control device 406 controls the operation of beam emitter 402 and monitors the receipt of the transmitted light by receiver 404. In the example of FIG. 7, alignment apparatus 400 is shown coupled to seat 28.

Control device 406 is similar to control device 110 described hereinabove with respect to FIG. 4 and comprises at least a switch 130 for activating the beam emitter 402 and a processor 132. Preferably, control device 406 further comprises a display console 134 and an alarm indicator 136.

Processor 132 is a standard processing unit capable of monitoring the beam emitter 402 and receiver 404 and indicating to the user whether the exercise machine 100 is correctly set In the embodiment of FIG. 7, alignment apparatus 400 comprises a pair of emitters (upper and lower beam) referenced 402*u* and 402*l*, respectively, and upper and lower receivers, referenced 404*u* and 404*l*, respectively. Light transmitted by upper and lower beam emitters 402*u* and 402*l*, are received by upper and lower receivers, 404*u* and 404*l*, respectively. Upper and lower beam emitters, 402*u* and 402*l*, respectively, are suitably attached to column 16, generally in line with the user's shoulders, proximate to the top of back support 30. Upper and lower beam emitters, 402*u* and 402*l*, respectively, are fixed a pre-determined distance, preferably a few centimeters, apart.

As illustrated in FIG. 3, the exerciser grips the hand grips 22 so that the angle of his elbow is approximately 90°. In order to achieve this angle, the seat 28 should be raised or lowered to suit. Depending on the seating position of the user, light may be received from one, both or neither of the upper and lower beam emitters, 402*u* and 402*l*, respectively. If the user is sat too low, light will be received from both transmitters and if the user is too high, light will not be received at all. When the user is correctly seated the lower beam emitter 402*l* is masked by the user's shoulders and light is not received by lower receiver 404*l*. The upper transmitter 402*u* is above the user's shoulders and the transmitted light is receivable by upper receiver 404*u*.

In operation, the user of the exercise machine 100 sits on seat 28 and actuates the upper and lower beam emitters, 402*u* and 402*l*, respectively. The user adjusts the seat 28 until light is only received from the upper transmitter 402*u*.

It will be appreciated, by persons knowledgeable in the art, that the embodiment illustrated in FIG. 7 can be combined with the embodiment illustrated in FIGS. 2 and 3.

It will be appreciated that the present invention is not limited to the various embodiment described hereinabove. For example, a second pair of beam emitters placed about 10 cm (approximately equivalent to the width of a persons shoulders) behind beam emitters 116 (when viewed from the front—FIG. 3). In a similar manner to that described for the embodiment of FIG. 7, the exercising unit (comprising adjustable element 112, members 21 and arms 20) can be adjustably moved perpendicular to the generally horizontal axis of adjustable element 112, until receptor 140 only receives light from the first beam emitter 116. If receptor 140 receives light from the second emitter, the apparatus is incorrectly positioned.

It will be further appreciated that the present invention is not limited by what has been described hereinabove and that numerous modifications, all of which fall within the scope of the present invention, exist. Rather the scope of the invention is defined by the claims which follow:

What is claimed is:

1. Apparatus for aligning an exercise machine having an adjustable element, the alignment apparatus comprising:

a. an operating device coupled to said adjustable element for adjustably positioning said adjustable element;

b. at least one beam emitter connected to said exercise machine; and c. a control device coupled to said operating device and said at least one beam emitter, wherein said at least one beam emitter emit rays to locate the optimum position of said adjustable element and wherein said operating device is actuated to move said adjustable element to said optimum position.

2. Apparatus according to claim 1, wherein said exercise machine comprises:

a. at least one pivotal element connected to said adjustable element; and b. a resistive component providing a counter force to the pivotal movement of said at least one pivotal element, said pivotal movement actuated by the body part being exercised, wherein each of said at least one beam emitter is connected to said at least one pivotal element and wherein each of said at least one beam emitter is located on an axial line about which said at least one pivotal element pivots.

3. Apparatus according to claim 2 and wherein said optimum position is determined by the beam being emitted by said at least one beam emitter being aligned with the joint of the body part being exercised.

4. Apparatus according to claim 1 and wherein said beam emitters emit light within the visible spectrum.

5. Apparatus according to claim 1 further comprising at least one receiver, each of said at least one receiver receiving rays emitted by the corresponding said at least one beam emitter.

6. Apparatus according to claim 1 and wherein said control device comprises a processing unit.

7. Apparatus according to claim 6 and wherein said processing unit processes data related to said rays being emitted and received, and controls the operation of said operating device ceases accordingly.

8. Apparatus according to claim 1 and wherein said operating device comprises an electric motor or a hydraulically or pneumatically driven unit.

9. Apparatus according to claim 1 and wherein said beam emitters are coupled to the operation of said operating device.

10. A method for aligning an exercise machine having an adjustable element, said method comprising the steps of:

a. activating a beam emitter;

b. locating the optimum position of said adjustable element; and c. actuating an operating device to operatably move said adjustable element to said optimum position.

11. A method according to claim 10 and wherein said locating the optimum position comprises the step of aligning the joint of the body part being exercised with the beam being emitted by said at least one beam emitter.

12. A method according to claim 10, wherein said exercise machine comprises:

a. at least one pivotal element connected to said adjustable element; and b. a resistive component providing a counter force to the pivotal movement of said at least one pivotal element, said pivotal movement actuated by the body part being exercised, wherein each of said at least one beam emitter is connected to said at least one pivotal element and wherein each of said at least one beam emitter is located on an axial line about which said at least one pivotal element pivots.

13. A method according to claim 10 and wherein said beam emitters emit light within the visible spectrum.

14. A method according to claim 10 and further comprising the step of receiving rays emitted by said at least one beam emitter.

15. A method according to claim 10 and further comprising the step of processing data related to said rays being emitted and received.

16. A method according to claim 15 and wherein said step of processing data comprises controlling the operation of said operating device.

17. A method according to claim 10 and wherein said steps of activating a beam emitter and actuating an operating device are coupled together.

* * * * *